United States Patent [19]

Kirby, Jr.

[11] 4,292,893

[45] Oct. 6, 1981

[54] ENDLESS BAND PRINTER WITH SPACERS BETWEEN DRIVE WHEELS

[75] Inventor: Raymond L. Kirby, Jr., Vandalia, Ohio

[73] Assignee: Monarch Marking Systems, Inc., Dayton, Ohio

[21] Appl. No.: 170,409

[22] Filed: Jul. 21, 1980

Related U.S. Application Data

[60] Continuation of Ser. No. 941,352, Sep. 11, 1978, abandoned, which is a continuation-in-part of Ser. No. 811,239, Jun. 29, 1977, abandoned, which is a division of Ser. No. 642,037, Dec. 18, 1975, Pat. No. 4,052,938, which is a continuation-in-part of Ser. No. 537,630, Dec. 30, 1974, Pat. No. 3,933,092.

[51] Int. Cl.[3] ..... B41J 1/20

[52] U.S. Cl. ..... 101/111

[58] Field of Search ..... 101/96, 99, 106, 109, 101/110, 111

[56] References Cited

U.S. PATENT DOCUMENTS

| | | | |
|---|---|---|---|
| 1,341,021 | 5/1920 | Robbins | 101/110 |
| 1,514,109 | 11/1924 | Stenstrom | 101/110 X |
| 3,927,613 | 12/1975 | Nantz | 101/110 |
| 3,965,815 | 6/1976 | Lupkas et al. | 101/110 X |
| 3,968,745 | 7/1976 | Hamisch | 101/111 |
| 4,018,157 | 4/1977 | Sato | 101/110 |
| 4,041,863 | 8/1977 | Mullen et al. | 101/110 |
| 4,050,375 | 9/1977 | Orlens | 101/110 |
| 4,090,442 | 5/1978 | Vazana et al. | 101/111 |

*Primary Examiner*—Edward M. Coven
*Attorney, Agent, or Firm*—Joseph J. Grass

[57] ABSTRACT

There is disclosed a print head with toothed drive wheels for advancing respective printing members such as printing bands. The print head has one or more blank elements or spacers having toothed surfaces defining a gap or space which enables an indexing gear to be shifted smoothly relative to the toothed drive wheels.

14 Claims, 30 Drawing Figures

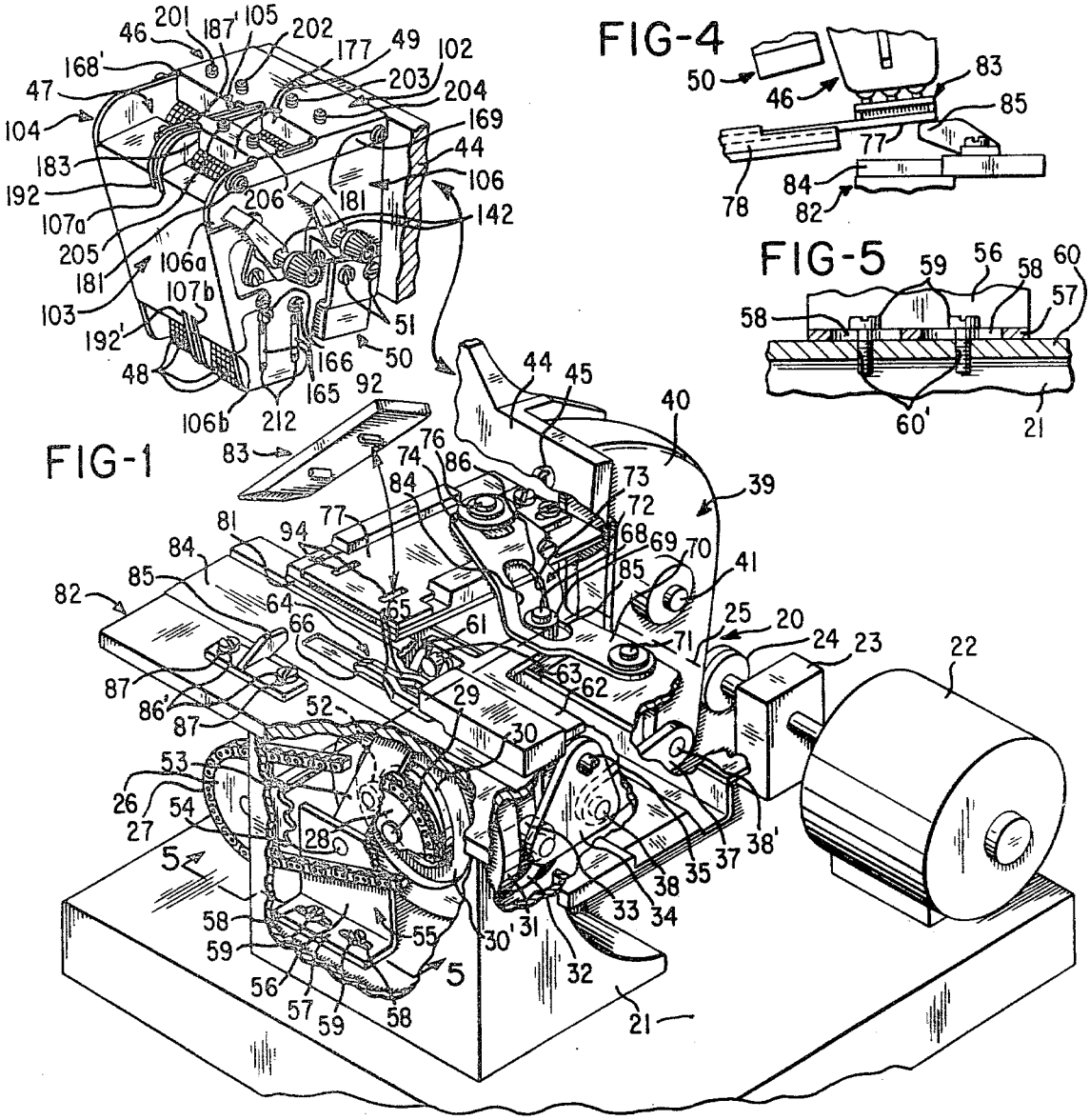
FIG-1
FIG-4
FIG-5
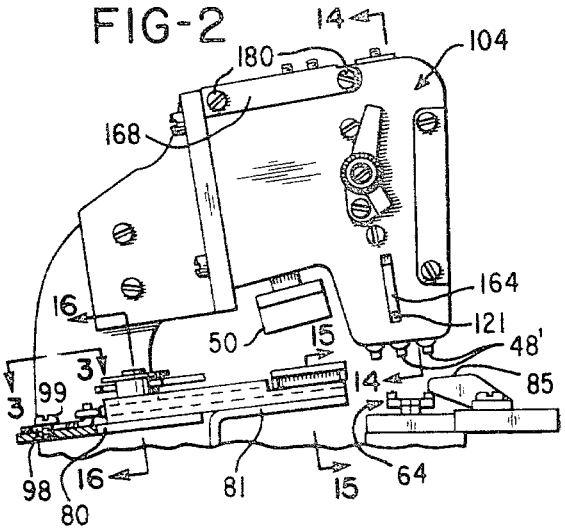
FIG-2
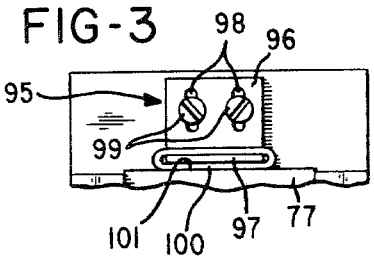
FIG-3

FIG-17
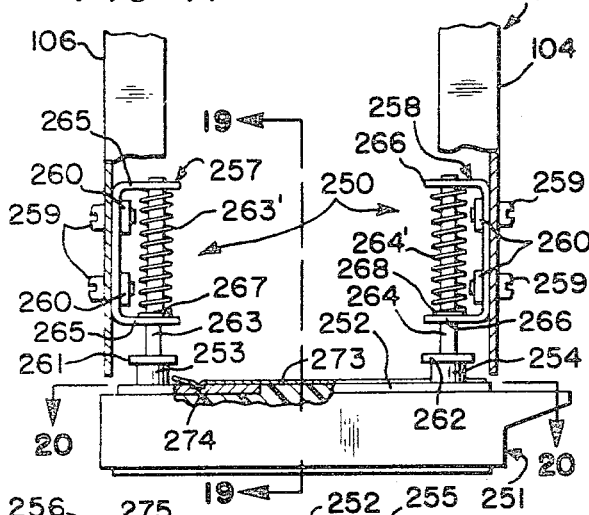
FIG-18
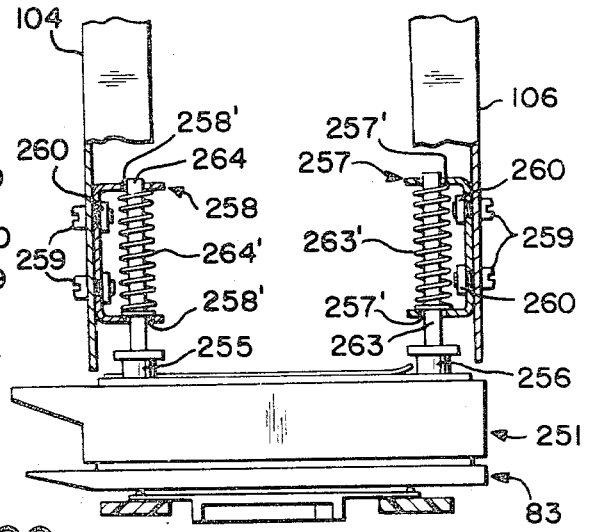
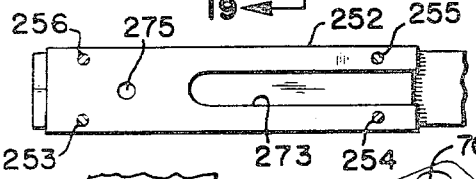
FIG-20
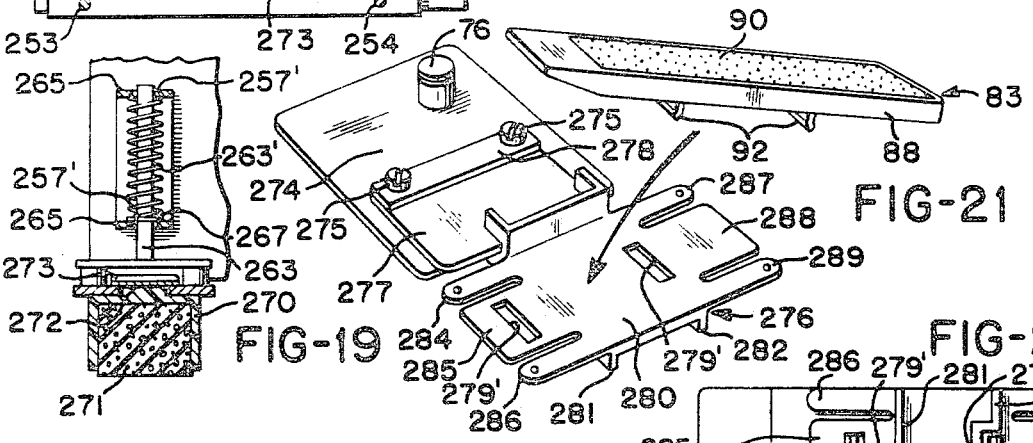
FIG-19
FIG-21
FIG-22
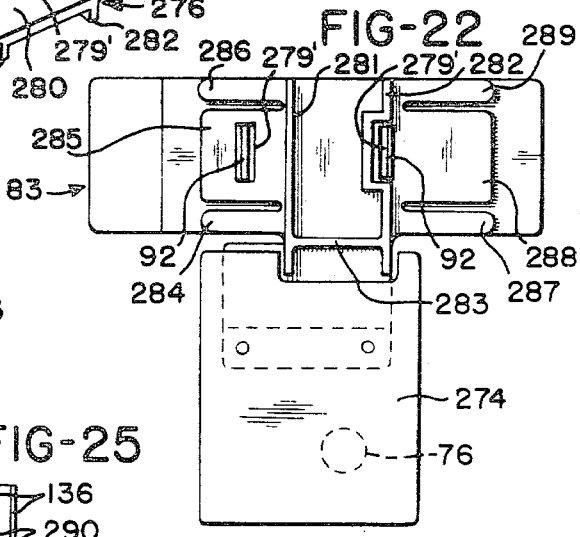
FIG-24
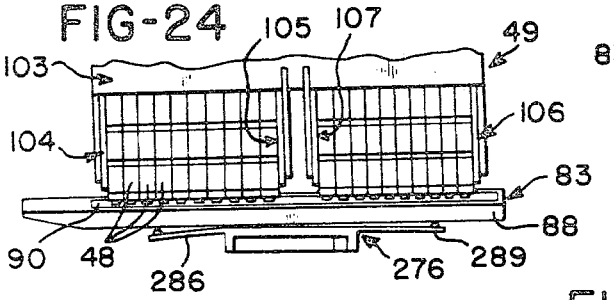
FIG-26
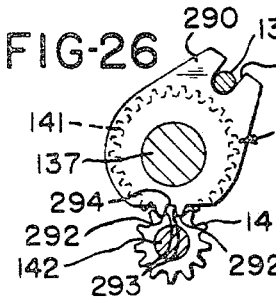
FIG-25
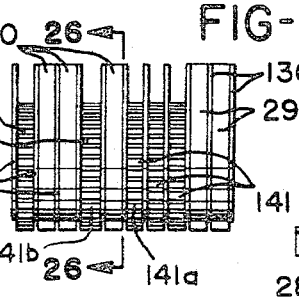
FIG-23
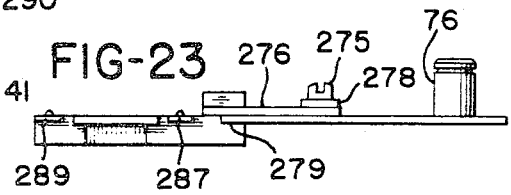

ENDLESS BAND PRINTER WITH SPACERS BETWEEN DRIVE WHEELS

CROSS-REFERENCE TO RELATED APPLICATIONS

This application is a continuation of Ser. No. 941,352, filed Sept. 11, 1978, now abandoned, which is a continuation-in-part of Ser. No. 811,239, filed June 29, 1977, now abandoned, which is a division of Ser. No. 642,037, filed Dec. 18, 1975, now U.S. Pat. No. 4,052,938, which is a continuation-in-part of Ser. No. 537,630, filed Dec. 30, 1974, now U.S. Pat. No. 3,933,092 and assigned to the same assignee as the present application.

BACKGROUND OF THE INVENTION

1. Field of the Invention

This invention relates to the art of printing apparatus.

2. Brief Description of the Prior Art

The disclosure in U.S. patent application Ser. No. 502,479, filed Sept. 9, 1974, now abandoned, and continuation applications Ser. No. 698,990, filed June 23, 1976, now abandoned, and Ser. No. 809,485, filed June 23, 1977 are considered to be prior art against the embodiment of FIGS. 17 through 26 of the present application and is owned by the same assignee as the present invention.

The following U.S. patents were cited during the prosecution of application Ser. No. 811,239: 636,524 of Ham,issued November, 1899; 1,980,576 of Flood, issued November, 1934; 3,024,724 of Angus, issued March, 1962; 3,482,512 of Jung, issued December, 1969; 3,601,042 of Hamisch, Sr., issued August, 1979; 3,889,594 of Nicholson, issued June, 1975; 3,968,745 of Hamisch, Jr., issued July, 1976 and 4,041,863 of Mullen et al, issued August, 1977.

SUMMARY OF THE INVENTION

A print head is provided with an arrangement of gears or drive wheels which can be indexed by means of a small gear or pinion which is selectively shiftable into meshing engagement with any drive wheel. Filler blocks or spacers are provided with tooth surfaces and an intervening space which is used to guide the pinion as the pinion is moved from one drive wheel to another drive wheel which is separated from the one drive wheel by such a spacer. Thus, the pinion can make a smooth transition as it is selectively moved.

BRIEF DESCRIPTION OF THE DRAWINGS

FIG. 1 is a partly exploded perspective view of printing apparatus in accordance with the invention;

FIG. 2 is a fragmentary left-side elevational view of the apparatus;

FIG. 3 is a view taken generally along line 3—3 of FIG. 2;

FIG. 4 is a fragmentary side elevational view showing a portion of the structure of FIG. 2, but with the ink pad being shown in the inking position;

FIG. 5 is a sectional view taken generally along line 5—5 of FIG. 1;

FIG. 17 is a fragmentary rear elevational view of the print head and the ink cartridge;

FIG. 18 is a fragmentary front elevational view of the print head with additional portions broken away for clarity and showing also an ink pad assembly and an ink pad assembly support;

FIG. 19 is a sectional view taken along line 19—19 of FIG. 17;

FIG. 20 is a sectional view taken along line 20—20 of FIG. 17;

FIG. 21 is an exploded perspective view of the ink pad assembly and the support;

FIG. 22 is a bottom plan view of the support and the assembly shown in FIGS. 18 and 21;

FIG. 23 is a side elevational view of the support and the assembly shown in FIG. 22 for example;

FIG. 24 is a front elevational view of the printer showing the ink pad of the assembly in inking cooperation with the print head;

FIG. 25 is a top plan view of a fragmentary portion of the print head;

FIG. 26 is a sectional view taken along line 26—26 of FIG. 25;

DETAILED DESCRIPTION OF THE PREFERRED EMBODIMENT

Figure 6:
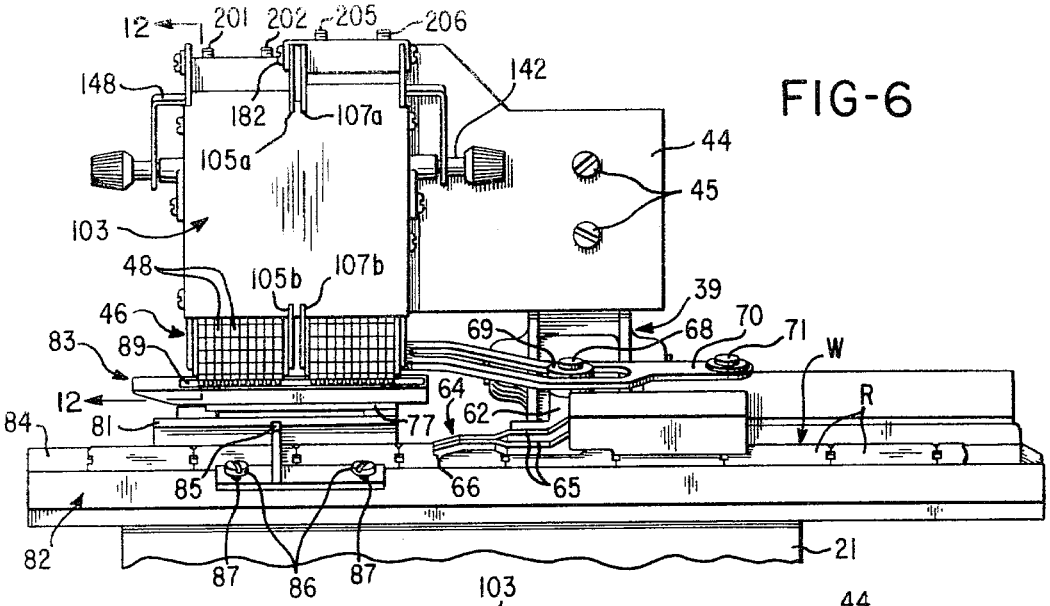
FIG. 6 is a front elevational fragmentary view showing the upper portion of the apparatus, the print head assembly, the feed finger and the inker being in their home positions.

With reference to FIG. 1, there is shown a printing apparatus 20 in accordance with the invention. The apparatus 20 is shown to include a frame 21, an electric motor 22 suitably secured to the frame 21, a speed reducer 23 coupled to the electric motor 22, and a clutch 24 coupled to the speed reducer 23. The clutch 24 is connected as indicated by a broken line 25 to a sprocket 26. The sprocket 26 is shown to drive a roller chain 27 which in turn drives a sprocket 28. The sprocket 28 is secured to cam shaft 29 to which a plate-like cam 30 having a continuous cam groove 30' and a barrel cam 31 are secured. The cam shaft 29 is suitably rotatably mounted by the frame 21. The cam 31 has a continuous cam groove 32. A roller 33 mounted by a plate 34 is received in the groove 32. The plate 34 is pivotally mounted by a post 35 secured to the frame 21. A link 37 is connected to the plate 34 by a pin 38 and to an actuator, generally indicated at 39 in the form of a lever 40, by a pin 38'. The actuator 39 is pivotally mounted on a pin or pivot 41 suitably mounted to the frame 21. A plate 44 is bolted to lever 40 by bolts 45. The plate 44 can be considered to be part of the actuator 39. A print head assembly generally indicated at 46 is secured to the plate 44. The print head assembly 46 includes a print head 47 illustrated as having one row of printing bands 48 and another print head 49 having two rows of printing bands 48. An ink cartridge generally indicated at 50 is suitably secured to the print head assembly 46 as by screws 51.

A roller 52 rotatably mounted to a lever 53 is captive in cam groove 30'. The lever 53 is pivotally mounted at its lower end by a pin 54 carried by a bracket 55. The bracket 55 has an upstanding portion 56 and a perpendicularly extending flange 57. The flange 57 has a pair of elongated slots 58. Bolts 59 pass through slots 58 and are threaded into holes 60' in upper wall 60 of the frame 21. It is apparent that the position of the bracket 55 and of the pivot 54 can be changed by loosening the bolts 59 and shifting the bracket 55 and then tightening the bolts 59.

Figure 7:
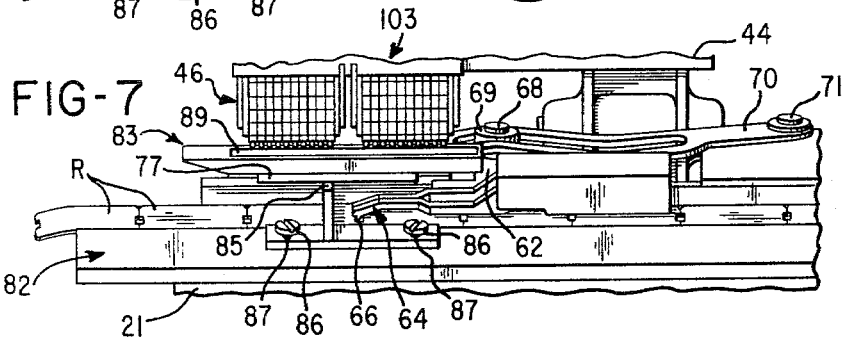
FIG. 7 is a view similar to FIG. 6, but showing only a fragmentary portion of the print head assembly, with the print head assembly raised, the ink pad being between the print head assembly and the platen and the feed finger being almost entirely in its forward position.
Figure 8:
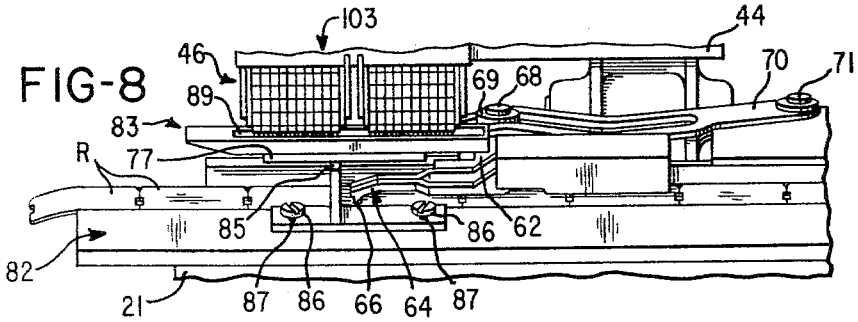
FIG. 8 is a view similar to FIG. 7, but showing the print head assembly lowered to receive ink from the ink pad and with the feed finger being in its fully forward position.
Figure 9:
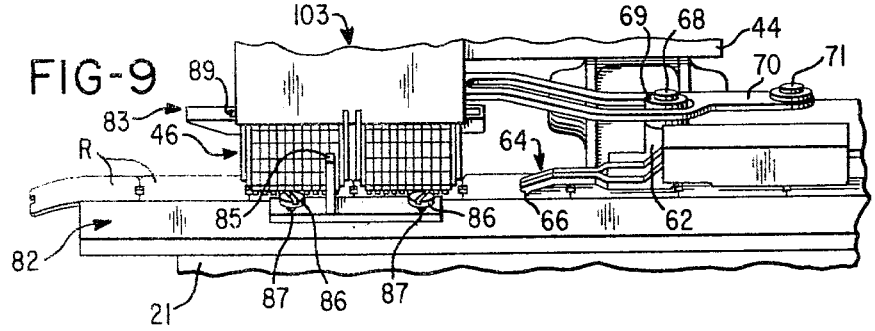
FIG. 9 is a view similar to FIGS. 7 and 8, but showing the print head assembly in its printing position with the feed finger and the ink pad being fully retracted.
Figure 16:
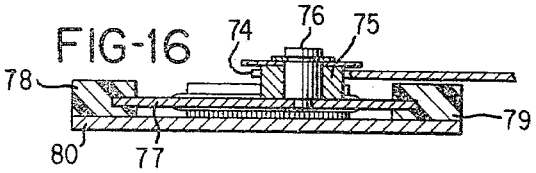
FIG. 16 is a sectional view taken generally along line 16—16 of FIG. 2.
Figure 27:
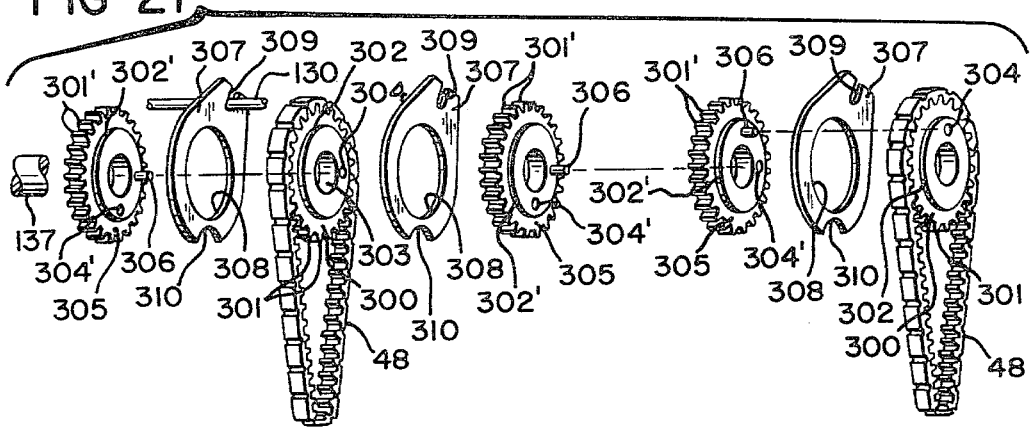
FIG. 27 is an exploded perspective fragmentary view of an alternative embodiment of a print head.
Figure 28:
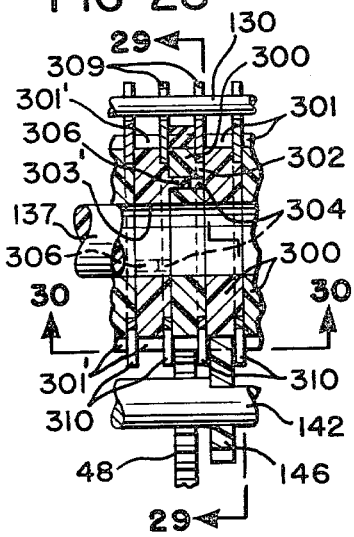
FIG. 28 is a sectional assembled view of the print head according to FIG. 27.
Figure 29:
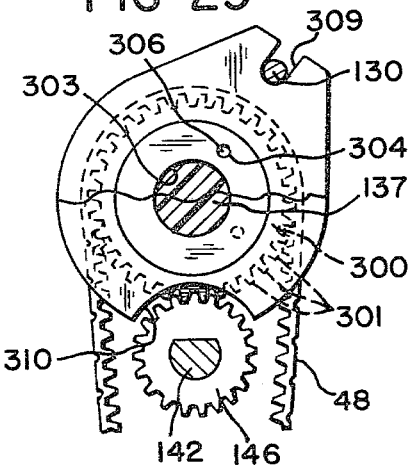
FIG. 29 is a sectional view taken generally along line 29—29 of FIG. 28.
Figure 30:
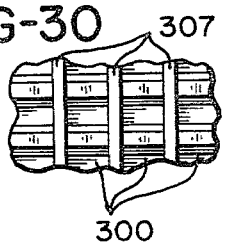
FIG. 30 is a bottom plan view taken along line 30—30 of FIG. 28.

The upper end of the lever 53 is fork-shaped as indicated at 61. A slide 62 is slideably mounted for movement to the left and to the right as view in FIGS. 6 through 9. The slide 62 has a pin 63 received in the fork-shaped end 61. The slide 62 carries a feed finger generally indicated at 64. The feed finger 64 is shown to be comprised of a pair of finger elements 65. Each finger element has a projection 66 for engaging a notch N in a web W of record members R. The record members can for example be tags interconnected in strip or web form or pressure sensitive labels removably carried on a web of supporting material. It is apparent that as the cam shaft 29 makes one complete revolution upon tripping of the single-revolution clutch 24, the cam 30 first pivots the lever 53 in the counterclockwise direction (FIG. 1) to move the feed finger 64 from the home position shown in FIG. 6 through the position shown in FIG. 7 to the fully forward or extended position shown in FIG. 8. During the remainder of the cycle the cam 30 drives the feed finger 64 from the position in FIG. 8 through the fully retracted position shown in FIG. 9 and thereafter the cam 30 pivots the lever 53 counterclockwise through a small arc to return the feed finger 64 to the home position shown in FIG. 6. The slide 62 carries a pin 68 on which a roller 69 is rotatably mounted. A lever 70 mounted on the pivot 71 secured to the frame 21 has a cam track generally indicated at 72. The cam track 72 is shown to be formed by a slot 73 formed in the lever 70. The roller 69 is received in the slot 73. The lever 70 has a forked end 74 which receives a roller 75 (FIG. 16) mounted on a post 76 to provide a pin and cut-out connection. The post 76 is secured to a plate-like carrier 77. The carrier 77 is guided in oppositely facing channel sections or guides 78 and 79. The channel sections 78 and 79 are secured to plates 80 and 81 secured to the frame 21.

As the lever 53 pivots during an operating cycle and while the feed finger 64 is being driven as indicated above, the roller 69 cooperates with the cam track 72 to pivot the lever 70 generally counterclockwise as viewed in FIG. 1 and thereafter to pivot the lever 70 clockwise. Thus, the carrier 77 which carries an ink pad assembly generally indicated at 83 is first moved from the retracted or home position shown in FIGS. 1 and 2 to the extended or inking position shown in FIG. 4. In the inking position, the ink pad assembly 83 is disposed between the print head assembly 46 and platen 84 which comprises part of the platen structure. The print head assembly 46 is shown in the same position in both FIGS. 4 and 7. The cam 32 is configured to initially raise the print head assembly 46 slightly so that the carrier 77 and its ink pad 83 can be moved to the extended position in the gap between the print head assembly 46 and the platen 84. Thereafter, when the carrier 77 is in the extended position, the profile of cam 32 causes the print head assembly 46 to be driven into ink receiving contact with the ink pad 83 and thereafter the profile of the cam 32 causes the print head assembly 46 to be raised, that is, driven away from the ink pad 83. While the print head assembly 46 is raised, the lever 53 begins its retracting movement and thus the roller 69 cooperates with the cam track 72 to return the carrier 77 and the ink pad 83 to the home position. As soon as the ink pad assembly 83 and its carrier 77 have moved (to the left as viewed in FIG. 4) clear of the print head assembly 46 and cam 32 drives the print head assembly 46 to the printing position shown in FIG. 9. In the printing position the record members R are printed and the ink pad 83 is simultaneously inked by means of the cartridge 50.

In accordance with a feature of the invention the length of travel of the feed finger 64 can be adjusted without affecting the travel of the carrier 77 and the ink pad 83. Adjustment of the bracket 55 to the left will decrease the stroke of the lever 53 and consequently the stroke of the feed finger 64, whereas shifting of the bracket 55 to the right will increase the strokes of the lever 53 and the feed finger 64. It is noted that the cam track 72 is comprised of rise or inclined portion 84' and dwell portions 85 and 86. Adjustment of the bracket 55 will change the initial position of the roller 69 in the cam track 72. More particularly the roller 69 will be positioned either generally to the left or generally to the right of the position shown in FIG. 1 depending upon the adjustment of the plate of the bracket 55. The adjustment of the bracket 55 is necessarily limited. The dwell portions 85 and 86 are so selected that irrespective of the length of stroke through which the lever 53 and the slide 62 are set to move, the roller 69 will only contact the rise portion 84' during the central or intermediate portion of the forward and retract travel of the slide 62. The cam track 72 and the roller 69 constitute a lost-motion connection between the slide 62 and the inker which includes the carrier 77 and the ink pad 83.

When the ink pad 83 and the carrier 77 are in the position shown in FIG. 4, the carrier 77 is supported by a support 85 mounted to the platen structure 82 in front of the platen 84. Screws 86' which pass through elongated slots 87 adjustably secure the support 85' in position. Screws 86' enable the support 85' to be positioned optimally relative to the carrier 77 by enabling the support 85' to be adjusted either to the left or to the right as viewed in FIG. 4. As seen in FIG. 4, when the print head assembly 46 moves into ink-receiving contact with the ink pad 83, the carrier 77 is supported not only at its left end (FIG. 4) by the channel sections 78 and 79, but also at its right end by the support 85'. Accordingly, the ink pad 83 and the carrier 77 are well supported while the print head assembly 46 is in ink-receiving contact with the pad 83 and yet neither the channel sections 78 and 79 and the associated plate 81 nor the support 85' interferes with any access to the platen 84 as is beneficial for instance during threading of the apparatus 20 with a web W of record members R.

Figure 15:
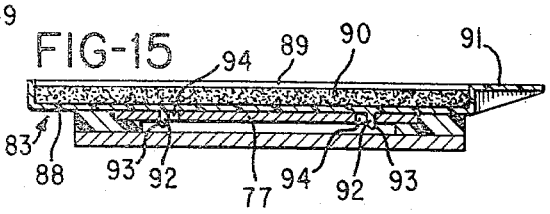
FIG. 15 is a sectional view taken generally along the line 15—15 of FIG. 2.

With reference to FIG. 15, there is shown an inker body 88 having a rectangular recess 89 for receiving a rectangular pad-like section of porous ink-receptive material 90. The inker body 88 has a handle 91 and a pair of flexible resilient fingers 92 formed integrally therewith. The fingers carry oppositely facing projections 93 which are shown to extend through holes 94 in the carrier 77 and releasably engage with the underside of the carrier 77. By positioning the ink pad 83 over the carrier 77 so that the fingers 92 are in alignment with the holes 94 and by depressing the ink pad 83, the fingers 92 will enter the holes 94 and the projections 93 will releasably hold the ink pad 83 in position.

With reference to FIGS. 2 and 3, there is shown a decelerator generally indicated at 95 which comprises a plate 96 having an upstanding flange or abutment 97. The plate 96 has elongated slots 98 through which screws 99 extend and are threadably secured to the plate 80. A cushion in the form of a flexible resilient O-ring 100 is received about the abutment 97. The O-ring 100 is in alignment with the rear face 101 of the carrier 77. As the lever 70 returns the carrier 77 to its home position shown in FIG. 3, the end 101 of the carrier 77 is driven against the O-ring 100, thereby bringing the carrier 77 to a stop with a minimum of vibration being transmitted to the remainder of the apparatus 20. The cushioning provided by the O-ring 100 is particularly advantageous in that there is slight clearance between the forked end 74 and the roller 75.

Figure 11:
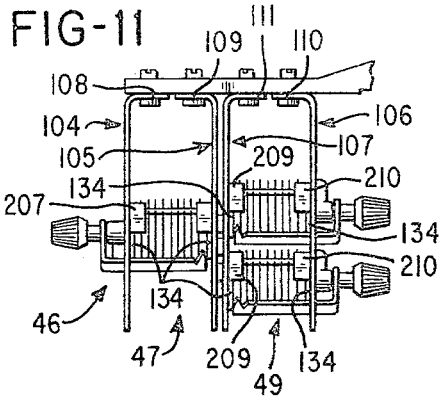
FIG. 11 is a top plan view of the print head assembly with the printing bands removed.
Figure 12:
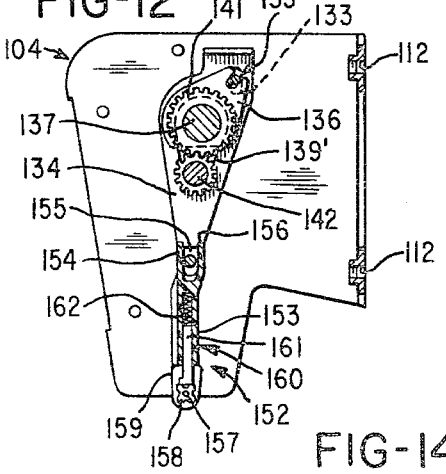
FIG. 12 is a view taken generally along line 12—12 of FIG. 6, with the printing band being omitted for the sake of clarity.
Figure 13:
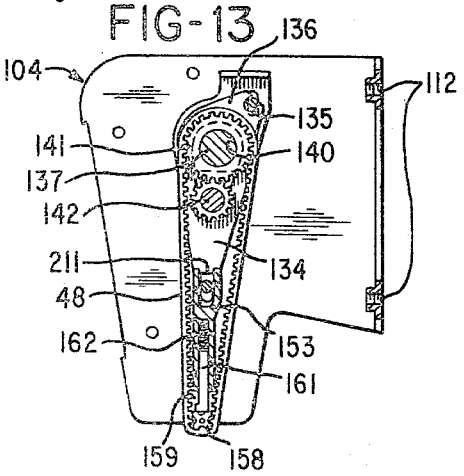
FIG. 13 is a view similar to FIG. 12, but showing the printing band received about a drive wheel of the support.

With reference to FIG. 11, which shows the print head assembly 46 minus plates 102 and 103 and printing bands 48, it is apparent that each print head 47 and 49 is comprised of a pair of spaced-apart side plates 104 and 105, and 106 and 107, although conceivably adjacent print heads can share a common side plate. Plates 104 and 105 have flanges 108 and 109 which extend toward each other, and the side plates 106 and 107 have flanges 110 and 111 that extend toward each other. Each of the flanges 108, 109, 110 and 111 has a pair of tapped holes 112, as best shown in FIG. 12.

Figure 10:
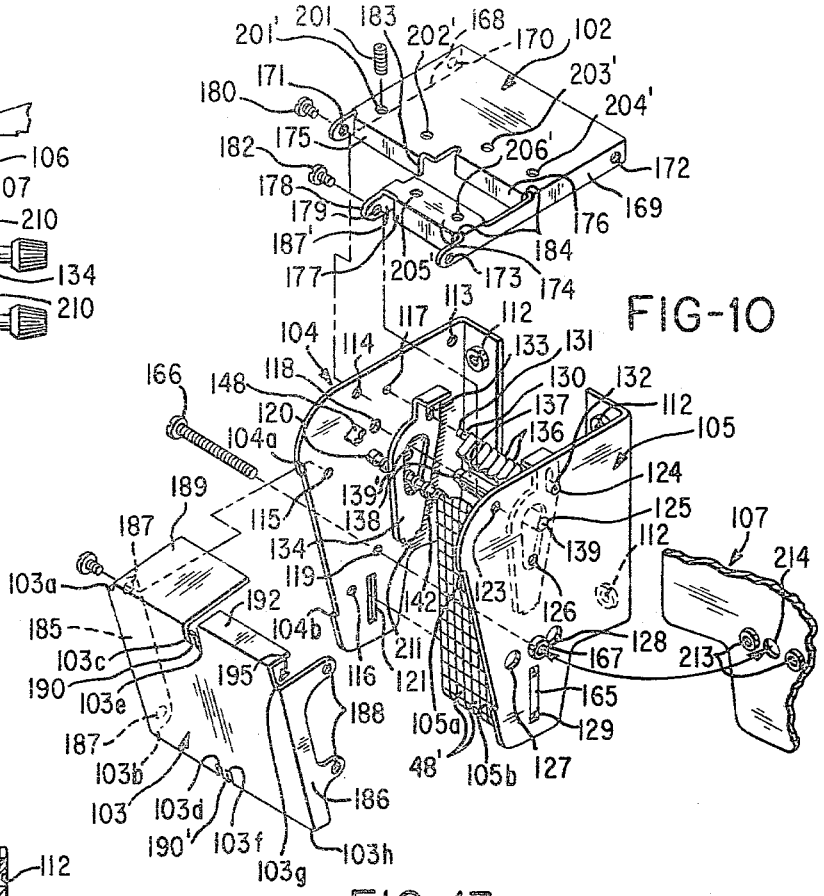
FIG. 10 is an exploded perspective view showing fragmentary portions of the print head assembly of the apparatus.

With reference to FIG. 10, the side plate 104 has holes 113, 114, 115, 116, 117, 118 and 119 and an elongated slot 121. The side plate 105 has holes 123, 124, 125, 126, 127 and 128 and an elongated slot 129.

Figure 14:
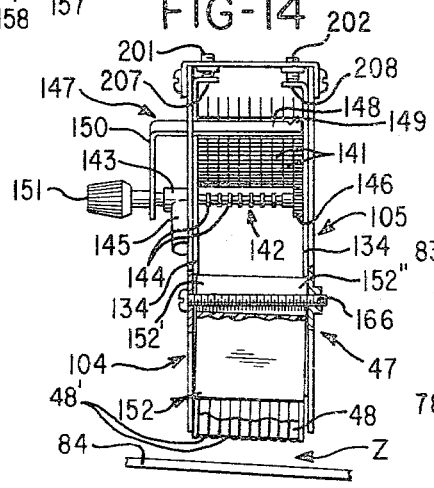
FIG. 14 is a front elevational view of one of the print heads with the printing bands broken away for clarity.

An annular shaft or rod 130 having reduced annular ends or end portions 131 and 132 received in respective holes 117 and 124 passes through elongated slots 133 in adjusting plates 134 and in elongated slots 135 in spacer plates 136. An annular rod or shaft 137 having reduced diameter end portions 138 and 139 received in respective holes 118 and 125 passes through cutouts 139' in adjusting plates 134 and through holes 140 in toothed drive wheels 141. A selector shaft 142 is mounted in a bushing 143 secured to the plate 104. The selector shaft 142 has a plurality of spaced-apart annular rings 144 which cooperate with a detent disposed in a tubular member 145 which opens into the bore of the bushing 143. The selector shaft 142 carries a gear 146 which can mesh with any one of the gears 141. An indicator generally indicated at 147 includes a longitudinally extending portion 148 which extends parallel to the axis of the drive wheels 141 and carries a pointer 149. The indicator 147 also includes a radially extending portion 150 joined to the longitudinally extending portion 148. The portion 150 is secured to the selector 142 between the bushing 143 and a knob 151. As shown in FIG. 14, the pointer 149 is aligned with the gear 146 and with the drive wheel with which the gear 146 cooperates, thereby in the position shown in the drawings, indicating that rotation of the knob 151 will cause rotation of the printing band 48 which is trained about the endmost drive wheel 141. By shifting the selector 142 to the left (FIG. 14) using the knob 151, the gear 146 can be meshed with any selected drive wheel 141. In that the gear 146 and the pointer 149 move as a unit, the pointer 149 will always be aligned with the gear 146 and will always indicate the drive wheel and consequently the printing band 48 with which the gear 146 is in driving cooperation.

A support generally indicated at 152 comprises a body 153 composed of plastics material. The upper end of the body 153 has a U-shaped portion 154 defining an open-ended channel 155 which is also open at the top 156. The body 153 mounts a shaft 157 which rotatably mounts wheels 158 which correspond to respective drive wheels 141. Spacers 159 separate adjacent wheels 158 from each other. The spacers 159 are large enough to separate adjacent printing bands 48 adjacent the printing zone Z. An individual detent 160, comprising a member 161 and a spring 162, acts on each respective wheel 158. The body 153 has integrally formed lugs 164 (FIG. 2) and 165 (FIG. 10) which are guidingly received in respective slots 121 and 129. Screw 166 passes through a hole 119 in the plate 104 and through the channel 155 and is threadably received in a threaded hole 167.

The plate 102 has a pair of flanges 168 and 169. The flange 168 has holes 170 and 171 and the flange 169 has holes 172 and 173. A plate portion 174 is integrally joined with the flange 169. The plate 102 has a pair of offset flanges 175 and 176 and the plate portion 174 has flanges 177 and 178. The flange 178 has a hole 179 aligned with the hole 123. The plate 102 is disposed at the tops of the side plates 104, 105, 106 and 107. Screws 180 pass through holes 170 and 171 and are threadably received in threaded holes 113 and 114. Screws 181 pass through holes 172 and 173 in the flange 169 and are threadably received in threaded holes in the side plate 106. Screw 182 extends through the hole 179 and is threadably received in the hole 123. As best seen in FIG. 1, the side plate 104 is snugly received in an opening 168' between the flange 168 and the flange 175, the side plate 105 is positioned against a face 183 of the flange 175, the side plates 105 and 106 are snugly received in an opening 187' between the flanges 177 and 178, and the side plate 106 is snugly received in openings 184 between the flanges 169 and 176 and 177. The plate 103 has flanges 185 and 186. The flange 185 has holes 187 and the flange 186 has holes 188. The plate 103 also has four flanges 189, 190, 190' and 192. The flanges 185 and 189 are laterally spaced apart so that shoulders **104*a* and 104*b* of the plate 104 can fit against respective shoulders 103*a* and 103*b* on the plate 103. The plates 105, 106, and 107 have shoulders 105*a* and 105*b*, 106*a* and 106*b*, and 107*a* and 107*b*. The flanges 186** and 192 are laterally offset to provide an opening 195 in which the side plate 106 can be snugly received. The plate 103 also has shoulders 103*c* through 103*h*. The shoulders 105*a* and 105*b* abut respective shoulders 103*c* and 103*d*, the shoulders 107*a* and 107*b* abut respective shoulders 103*e* and 103*f*, and shoulders 106*a* and 106*b* abut respective shoulders 103*g* and 103*h*. The plates 104, 105, 106 and 107 are constructed indentically except as otherwise noted. It is thus apparent that the plates 44, 102 and 103 rigidly structurally interconnect the plates 104, 105, 106, 107 into a sturdy print head assembly 46.

With reference to FIGS. 1 and 10, set screws 201, 202, 203, 204, 205, and 206 are threadably received in respective threaded holes 201' through 206'. As shown in FIG. 14 for example, screws 201 and 202 contact flanges 207 and 208 of respective adjusting plates 134. The flanges 207 and 208 of the adjusting plates 134 of the print head 47 extend toward each other laterally of respective side plates 104 and 105. Flanges 209 and 210 of the adjusting plates 134 extend toward each other laterally of respective side plates 107 and 106. The adjusting plates 134 includes a projection 211 received in the channel 155 in the U-shaped end 154 of the support body 153. In that the support 152 is guided for straight line movement by means of its lugs 164 and 165 received in respective slots 121 and 129 and because the rod 130 is received in elongated slots 133, the plates 134 are also guided for straight line movement. The print head 47 has a pair of adjusting plates 134 disposed between and in contact with the side plates 104 and 105 and endmost drive wheels 141. It is apparent from FIG. 14 that adjustment of screws 201 and 202 will cause respective ends 152' and 152" of the support 152 to be moved selected distances against the forces exerted by the printing bands which are under tension. More particularly, the adjusting plates 134 exert downward forces on the ends 152'and 152" and the printing bands 48 acting against the wheels 158 exert an upward force on the support so therefore in the event that set screws 201 and/or 202 are rotated to move in an upward direction as viewed in FIG. 14, the forces which the printing bands 48 exert upwardly on the wheels 158 will prevent the forked end 154 from losing contact with the adjusting plates 134 and will prevent the flanges 207 and 208 from losing contact with respective set screws 201 and 202. In FIG. 14, the support 152 has been oriented exaggeratedly but in parallel relationship with respect to the upper surface of the platen 84 by use of adjusting screws 201 and 202. Once this adjustment has been made, screw 166 is tightened, thereby clamping the support 152 securely in the adjusted position. There is enough clearance between the plates 104 and 105 so that the support 152 can be skewed relative to the plates 104 and 105 as shown exaggeratedly in FIG. 14. In order to change the adjustment, the screw 166 is loosened and set screws 201 and 202 are adjusted until the printing elements 48' on bands 48 are correctly oriented with respect to the platen and thereupon screw 166 can be tightened again. The same adjusting procedure applies to the print head 49.

With respect to the print head 49 which can print two rows of data, there are two sets of printing bands 48, two sets of drive wheels 141, two supports 152, two sets of adjusting plates 134, and associated components. Accordingly, the print head 49 differs to the extent that the side plates 106 and 107 are provided with two slots 212 for receiving lugs 164 and 165. The plates 106 and 107 also have the necessary holes for accommodating the selector shafts 142 and rods 130 and 137. The plate 107 has internally threaded bosses 213 for threadably receiving respective screws 166. Bosses 166 extend into clearance holes 127 and 128 in the plate 105. The plate 107 also has a clearance hole 214 for receiving the internally threaded boss 167 of the plate 105.

With reference to FIGS. 17 through 24 and initially to FIGS. 17 and 18, there is shown a mechanism generally indicated at 250 for yieldably mounting an ink cartridge generally indicated at 251 to the plates 104 and 106 of the print head 49. The mechanism 250 includes a generally U-shaped support 252 and preferably four studs or posts 253, 254, 255 and 256. The mechanism 250 also includes what are shown to be two generally U-shaped brackets 257 and 258 secured to the plates 106 and 104 by screws 259 and nuts 260. The posts 253 and 256 are secured to a plate 261 and the posts 254 and 255 are secured to a plate 262. Posts 263 and 264 are mounted for guided movement by the respective brackets 257 and 258. The brackets 257 and 258 have respective pairs of arms 265 and 266. Abutment members or abutments 267 and 268 in the form of C-rings are secured to the respective posts 263 and 264. A compression spring 263' received about the post 263 between the arms 265 bears against one of the arms 265 and the abutment 267. A compression spring 264' received about the post 264 between the arms 266 bears against one of the arms 266 and the abutment 268. The abutments 267 and 268 are considered to be part of the respective posts 263 and 264. As best seen in FIGS. 18 and 19 the posts 263 and 264 are loosely received in oversize holes 257' and 258' in the respective brackets 257 and 258. The loose fit between the posts 263 and 264 and the respective holes 257' and 258' enables the cartridge 251 to cant at any angle within practical limits when the cartridge 251 is in ink transferring contact with the ink pad 90 of the ink pad assembly 83. As shown in FIG. 19 the ink cartridge 251 has an ink cartridge body 270 which carries a pad 271 composed of ink receptive material from which ink can be transferred to the ink pad 90. The cartridge body 270 has a rib 272 which is received in an open-ended opening 273 in the support 252 and a resilient retainer 273 has a projection 274 engaged in a recess in the support 252 to releasably hold the cartridge 251 to the support 252.

With reference to FIG. 21, the post 76 is secured to a carrier 274 which is guided in the same manner that the carrier 77 is guided. Secured to the carrier 274 by screws 275 is a one-piece molded plastics support generally indicated at 276. The support 276 has a mounting portion 277 through which the screws 275 pass. The screws 275 urge a plate 278 against the portion 277. The support 276 has a groove 279 in which the carrier 274 is received. Thus, the carrier 274 cooperates with the notch 279. The screws 275 and the plate 278 hold the mounting portion 277 securely to the carrier 274. The support 276 has a pair of holes 279' for receiving the resilient fingers 92 in the same manner that the resilient fingers 92 were received in the holes 94. The support has a central portion 280 provided with ribs 281, 282 and 283 so that central portion 280 is relatively rigid. Extending outwardly from the central portion are flexible resilient fingers 284 through 289. The fingers 284 through 286 are disposed at one end of the support 276 and the spring fingers 287 through 289 are disposed at the other end of the support 276. The spring fingers 284 and 286 are disposed outboard of the spring finger 285 and the spring fingers 287 and 289 are disposed outboard of the spring finger 288. The spring finger 285 can exert a greater spring force than related spring fingers 284 and 286 and the spring finger 288 can exert a greater spring force than the spring fingers 287 and 289. The body 88 is relatively thin and is composed of flexible material. In FIG. 24 the support 276 and the ink pad assembly 83 are shown in ink transferring relationship with respect to the printing bands 48. As shown in FIG. 24 the ink pad assembly 83 can flex during the inking to accommodate unequal forces exerted by the various printing bands on the pad 90. FIG. 24 shows exaggeratedly that the front spring finger 286 is flexed to a greater extent than the front spring finger 289 due to a twisting or warping of the elongated ink pad assembly 83 while the print head 49 is in ink receiving contact with the ink pad assembly 90.

With reference to FIGS. 25 and 26, there is shown a modification to the print head 49 from that shown in the foregoing figures of the drawings which enables a smooth transition of the gear 146 during the selection process even though there is a gap between adjacent drive wheel 141. It is sometimes desirable to have the printing bands 48 in the print head spaced apart so that the printed on the record R such as a tag or label are spaced apart. According to the invention, spacers 290 occupy the space between some of the drive wheels 141 as shown in FIG. 25. The spacers 290 are identical and hence only one is described in detail. With reference to FIG. 26, the spacer 290 is provided with a notch 291 which receives the rod 130. Each spacer 290 has the same width as a drive wheel 141 and is otherwise constructed the same as the spacer plates 136 except that the spacers 290 have teeth 292. The teeth 292 have adjacent tooth surfaces 293 which define an intervening space 294. As the gear 146 is shifted from engagement with one of the drive wheels 141, for example the drive wheel 141*a*, in meshing engagement with the teeth of the drive wheel 141*b*, the space 294 between the teeth 292 enables the gear 146 to be guided. The surfaces 293 are profiled to mate with a tooth on the gear 146. Absent the toothed surfaces 293 the user would have to work the gear 146 into alignment with the teeth on the drive wheel 141*b* in passing from the drive wheel 141*a* to the drive wheel 141*b*. Accordingly, the spacers 290 facilitate ease of shifting the gear 146. The space 294 is always aligned with a tooth of the gear 146, except when the gear 146 is being rotated to advance a selected printing band 48, due to the action of the detent 160 associated with the drive wheel 141 with which the gear 146 is in mesh.

Alternatively the spacer 290 can be as wide as necessary to fill up any desired space in the print head between spaced wheels 141. Alternatively, the spacer plates 136 can be eliminated by making the spacers 290 wide enough to equal the width of a wheel 141 plus the width of either one or two spacer plates 136.

With reference to the embodiment of FIGS. 27 through 30, there is shown a further embodiment of a print head from those shown in the foregoing figures of the drawings. Like in the embodiment of FIGS. 25 and 26, the embodiment of FIGS. 27 through 30 enables a smooth transition of the gear 146 during the selection process even though there is a gap between adjacent drive wheels 300. The drive wheels 300 are shown to have teeth 301 at their respective annular peripheries. The teeth are preferably gear teeth of the involute type. The wheels 300 are generally disc-shaped. Each wheel 300 has a short axially extending annular shoulder 302. The shoulder 302 accounts for only a small portion of the width of drive wheel 300. Each drive wheel has a central hole 303 through which shaft 137 is received. The radial extent of the shoulder 302 is greater than the diameter of the hole 302 but less than the radius of the wheel 300 to the root or base of the teeth 301. Each wheel 300 has recess or through-hole 304. The drive wheels 300 are preferably identical as shown.

Spacers 305 are preferably identical to the drive wheels 300 except that each spacer 305 has a pin or projection 306 aligned with the hole 304 of a drive wheel or with a recess or through-hole 304' of another spacer 305. The spacers 305 have teeth 301' at their respective annular peripheries. The teeth 301' are preferably identical to the gear teeth 301. The spacers 305 are generally disc-shaped. Each spacer has a short axially extending shoulder 302' and a central hole 303'.

Retainers 307 have annular through-holes 308 which receive either a respective shoulder 302 or a respective shoulder 302'. The retainers 307 are retained in the assembled position by shoulders 302 or 302' as the case may be and by the rod 130 which passes through the respective notches 309. Each retainer 307 is generally annular but has a cut-out which enables the gear 146 to be shifted into meshing engagement with any drive wheel 302 or any spacer 302'. The cut-out 310 is shown to extend beyond the external periphery of the gear 146.

The printing bands 48 are shown to engage the teeth 301 of the drive wheels 200. The two retainers 307 which straddle a printing band 48 and a drive wheel 300 retain the printing band 48 on that drive wheel. Thus, the straddled printing band 48 is held captive. There is no need for a retainer 307 between adjacent spacers 305 which are locked or keyed to each other.

As in the embodiment of FIGS. 25 and 26, the spacers 305 facilitate shifting the gear 146. The teeth 301 are always aligned with the teeth 301' and thus the space between adjacent teeth 301 and 301' is always aligned with a tooth of the gear 146 except when the gear 146 is being rotated to advance a selected printing band 48, due to the action of the detent 160. In that each spacer 305 is keyed either directly to a drive wheel 300 or indirectly to a drive wheel 300 through another spacer or spacers 305, the drive wheel 300 and spacer or spacers 305 which are keyed to each other rotate as a unit on the shaft 137. Thus, the drive wheel 300 and the spacer or spacers 305 that are keyed to it cannot become angularly displaced from each other.

Other embodiments and modifications of this invention will suggest themselves to those skilled in the art, and all such of these as come within the spirit of this invention are included within its scope as best defined by the appended claims.

I claim:

1. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one non-printing spacer disposed between a pair of adjacent drive wheels, each spacer having adjacent tooth surfaces and an intervening space in line with a space between adjacent teeth on the drive wheels to enable a smooth transition as the gear is shifted from contact with the teeth of one drive wheel on one side of the spacer and the teeth of another drive wheel on the other side of the spacer.

2. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one non-printing spacer locked in a predetermined orientation and disposed between a pair of adjacent drive wheels, each spacer having adjacent tooth surfaces and an intervening space in line with a space between adjacent teeth on the drive wheels to enable a smooth transition as the gear is shifted from contact with the teeth of one drive wheel on one side of the spacer and the teeth of another drive wheel on the other side of the spacer.

3. Print apparatus as defined in claim 2, including spacer plates between adjacent drive wheels, and means for locking the spacers and the spacer plates in a predetermined orientation.

4. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one separate, rotatably mounted, non-printing spacer disposed between a pair of adjacent drive wheels, each spacer having gear teeth, means for locking each spacer to one of the drive wheels to hold the gear teeth of the spacer aligned with the gear teeth of the drive gear to enable a smooth transition as the drive gear is shifted from contact with the teeth of one drive wheel on one side of the spacer and the teeth of another drive wheel on the other side of the spacer.

5. Printing apparatus as defined in claim 4, wherein there are at least two of said spacers between a pair of adjacent drive wheels, the at least two spacers being locked to each other.

6. Printing apparatus as defined in claim 5, wherein the spacers are identical.

7. Printing apparatus as defined in claim 5, wherein each spacer includes a pin and the respective drive wheel includes a recess for receiving the pin, each spacer including a recess for receiving a pin of another spacer.

8. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one non-printing spacer disposed between a pair of adjacent drive wheels, each spacer having adjacent tooth surfaces and an intervening space in line with a space between adjacent teeth on the drive wheels to enable a smooth transition as the gear is shifted from contact with the teeth of one drive wheel on one side of the spacer and the teeth of another drive wheel on the other side of the spacer, wherein each spacer includes a spacer plate, and means for locking the spacer plate or plates permanently in a predetermined orientation.

9. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one separate, rotatably mounted, non-printing spacer disposed between a pair of adjacent drive wheels, each spacer having gear teeth, means for locking each spacer to one of the drive wheels to hold the gear teeth of the spacer aligned with the gear teeth of the drive gear to enable a smooth transition as the drive gear is shifted from contact with the teeth of one drive wheel on one side of the spacer and the teeth of another drive wheel on the other side of the spacer, a retainer disposed between each spacer and the respective drive wheel for maintaining the printing band on the respective drive wheel.

10. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one separate, rotatably mounted, non-printing spacer disposed between a pair of adjacent drive wheels, each spacer having gear teeth, means for locking each spacer to one of the drive wheels to hold the gear teeth of the spacer aligned with the gear teeth of the drive gear to enable a smooth transition as the drive gear is shifted from contact with the teeth of one drive wheel on one side of the spacer and the teeth of another drive wheel on the other side of the spacer, a retainer disposed between each spacer and the respective drive wheel for maintaining the printing band on the respective drive wheel, wherein the retainer has a greater radial extent than the radial extent of the respective drive wheel, and means for locking the retainer against rotation.

11. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one separate, rotatably mounted, non-printing spacer disposed between a pair of adjacent drive wheels, each spacer having gear teeth, means for locking each spacer to one of the drive wheels to hold the gear teeth of the spacer aligned with the gear teeth of the drive gear to enable a smooth transition as the drive gear is shifted from contact with the teeth of one drive wheel on one side of the spacer and the teeth of another drive wheel on the other side of the spacer, wherein each spacer has a shoulder, and a retainer received on the shoulder for maintaining the printing band on the respective drive wheel, the retainer having a greater radial extent than the radial extent of the respective drive wheel, and means for lockng the retainer against rotation.

12. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one separate, rotatably mounted, non-printing spacer disposed between a pair of adjacent drive wheels, each spacer having gear teeth, means for locking each spacer to one of the drive wheels to hold the gear teeth of the spacer aligned with the gear teeth of the drive gear to enable a smooth transition as the drive gear is shifted from contact with the teeth of one drive wheel on one side of the spacer and the teeth of another drive wheel on the other side of the spacer, wherein each spacer includes a pin and the respective drive wheel includes a recess for receiving the pin.

13. Printing apparatus, comprising: a print head having a plurality of rotatably mounted drive wheels having gear teeth, a support, a series of printing bands trained about the support and the drive wheels, a shiftable drive gear selectively cooperable with the gear teeth on any drive wheel, the improvement comprising at least one non-printing spacer disposed between a pair of adjacent drive wheels, each spacer having adjacent tooth surfaces and an intervening space in line with a space between adjacent teeth on the drive wheels to enable a smooth transition as the gear is shifted from contact with the teeth of one drive wheel on one side of the spacer and the teeth of another drive wheel on the other side of the spacer, and means for locking each said non-printing spacer in a fixed orientation with respect to the drive wheels.

14. Printing apparatus, comprising: a print head having a plurality of rotatably mounted drive wheels having teeth, a support, a series of printing bands trained about the support and the drive wheels, a shiftable manually operable selector selectively cooperable with the teeth on any drive wheel, the improvement comprising at least one non-printing spacer disposed between a pair of adjacent drive wheels, each spacer having adjacent tooth surfaces and an intervening space in line with a space between adjacent teeth on the drive wheels to enable a smooth transition as the selector is shifted from contact with the teeth of one drive wheel on one side of the spacer and the teeth of another drive wheel on the other side of the spacer, the selector having a tooth guided through the intervening space by the adjacent tooth surfaces as the transition is made.

* * * * *